United States Patent [19]

Satoh

[11] 4,370,591

[45] Jan. 25, 1983

[54] COLOR PICTURE TUBE SHADOW MASK

[75] Inventor: Yoshio Satoh, Mobara, Japan

[73] Assignee: Hitachi, Ltd., Tokyo, Japan

[21] Appl. No.: 179,475

[22] Filed: Aug. 18, 1980

[30] Foreign Application Priority Data

Sep. 14, 1979 [JP] Japan ..... 54-117251
Nov. 14, 1979 [JP] Japan ..... 54-146559

[51] Int. Cl.[3] ..... H01J 29/07; H01J 29/80
[52] U.S. Cl. ..... 313/402; 313/408
[58] Field of Search ..... 313/472, 408, 402

[56] References Cited

U.S. PATENT DOCUMENTS

Re. 27,259 12/1971 Rublack ..... 313/408
3,486,061 12/1969 Barten ..... 313/408
3,590,303 6/1971 Coleclough ..... 313/408
3,705,322 12/1972 Naruse et al. ..... 313/408

FOREIGN PATENT DOCUMENTS 54-97360 8/1979 Japan ..... 313/408

*Primary Examiner*—Robert Segal
*Attorney, Agent, or Firm*—Charles E. Pfund

[57] ABSTRACT

In a color picture tube especially incorporating an in-line dot type shadow mask, the horizontal arrangement of the apertures of the shadow mask is determined to make substantially equal the interdistance between adjacent electron beams formed on the fluorescent screen based on beams of electron passing through apertures at the corners of the shadow mask, thereby making full use of the purity tolerance.

4 Claims, 10 Drawing Figures

COLOR PICTURE TUBE SHADOW MASK

BACKGROUND OF THE INVENTION

The present invention relates to color picture tubes, and more particularly a color picture tube of an in-line dot type intended for fine and high-quality display of characters with an improved purity and completeness of the picture image over the whole screen.

In the color picture tube of in-line dot type used, for example, as a video data terminal unit, as well known in the art, a fluorescent screen consisting of a plurality of phosphor dots is formed on the inner surface of a panel of a glass bulb serving as a vacuum envelope. A dot type shadow mask having circular apertures which are arrayed horizontally and vertically is spaced apart from the fluorescent screen by a predetermined distance. Mounted in the envelope is an in-line type three-electron-gun structure which opposes the shadow mask. Beams of electron emitted from the electron gun structure pass through apertures of the shadow mask and impinge upon the fluorescent screen to establish trios of electron beams.

With the in-line dot type color picture tube, when the electron beam is scanned in horizontal and vertical directions, three electron beams pass through one of the apertures in the shadow mask to form a trio of electron beams on the fluorescent screen. The arrangement of such a trio of electron beams is distorted at points on each scanning line as indicated in FIG. 1 due to the surface geometry of the panel and the deflecting magnetic field characteristics of the deflection yoke. As a result, a line connecting the beam trio is inclined by an inclination angle $\phi$ in respect of the horizontal line. This tendency is aggravated at four corners of the screen.

In a conventional shadow mask, however, apertures at the central portion and apertures at the corner are aligned horizontally and this horizontal arrangement is straightforward. When trios of electron beams are established at the corners through such a shadow mask, the interdistance between adjacent electron beams on the fluorescent screen becomes irregular as shown in FIG. 2 with the result that tolerance for color purity is degraded. More particularly, when taking trios of electron beams $\mathbf{20}b_1$, $\mathbf{20}g_1$ and $\mathbf{20}r_1$; $\mathbf{20}b_2$, $\mathbf{20}g_2$ and $\mathbf{20}r_2$; $\mathbf{20}b_3$, $\mathbf{20}g_3$ and $\mathbf{20}r_3$; and $\mathbf{20}b_4$, $\mathbf{20}g_4$ and $\mathbf{20}r_4$ for example, beams $\mathbf{20}g_1$, $\mathbf{20}r_1$ and $\mathbf{20}b_3$ are spaced from each other at an equi-distance, thereby forming an approximate equilateral triangle and do not degrade the purity tolerance. However, the interdistance between adjacent beams $\mathbf{20}r_1$ and $\mathbf{20}b_2$ is extended whereas the interdistance between adjacent beams $\mathbf{20}b_2$ and $\mathbf{20}g_3$ is narrowed. Consequently, the interdistance between some of adjacent electron beams becomes irregular and the purity tolerance becomes considerably degraded as compared to one that will fully be capable of utilizing the dimensions of the trio of dots on the fluorescent screen and electron beams. The limitations on the purity tolerance cannot be eliminated whatever design correction lens is used when forming the phosphor dots.

Thus, it was the practice in the conventional art to place an inner shield inside the bulb to cure the effect of the earth magnetism, or to decrease the aperture diameter through the shadow mask. Alternatively, the difference in grading for the shadow mask is increased as compared with that of a shadow mask for the other types, i.e., electron gun and stripe shadow mask type and delta electron gun and dot shadow mask type.

However, if the difference in grading is increased, the completeness of the picture image throughout the screen becomes impaired, and hence, the quality of the picture image becomes degraded, thus imposing disadvantages on the graphic display. Decreased aperture diameter at the central portion for the overall completeness of the picture image will decrease utilization efficiency of the electron beams. On the other hand, the otherwise unnecessary excessive current flow will be needed in order to obtain the predetermined brightness, which deteriorates the focusing, damages the high resolution required of the high definition tube and increases the burden on the cathode electrode, thus shortening lifetime.

SUMMARY OF THE INVENTION

The present invention contemplates elimination of the prior art drawbacks and has for its object to provide a color picture tube which can improve purity characteristics throughout the picture screen.

Another object of the present invention is to provide a color picture tube having high utilization efficiency of the electron beams.

According to the present invention, in a color picture tube comprising a fluorescent screen formed on the inner surface of the panel and consisting of a plurality of trios of phosphor dots, a dot type shadow mask having circular apertures which are arrayed horizontally and vertically and spaced from the fluorescent screen by a predetermined distance, and an in-line type three-electron-gun structure for emitting beams of electron which pass through apertures of the shadow mask and impinge upon the fluorescent screen to establish trios of electron beams, the horizontal arrangement of the apertures of the shadow mask is such that the interdistance between adjacent electron beams on the fluorescent screen based on beams of electrons passing through apertures at the corners of the shadow mask is made substantially equal.

DESCRIPTION OF THE PREFERRED EMBODIMENTS

Figure 1:
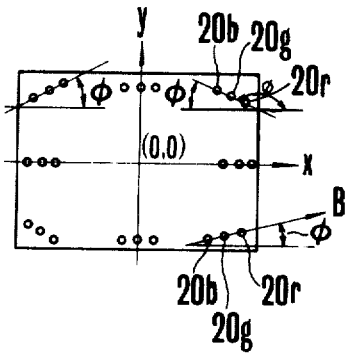
FIG. 1 shows an arrangement of trios of electron beam distorted at the time of beam deflection.
Figure 2:
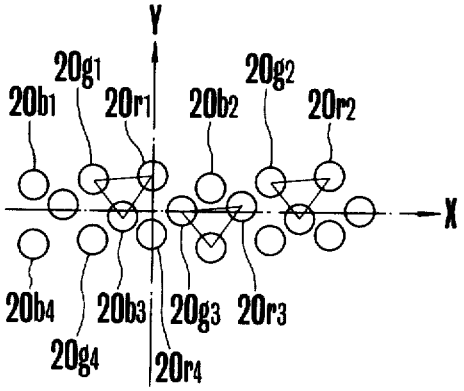
FIG. 2 is a diagram useful in explaining the irregular interdistance between adjacent electron beams at the corner of a prior art shadow mask.
Figure 3:
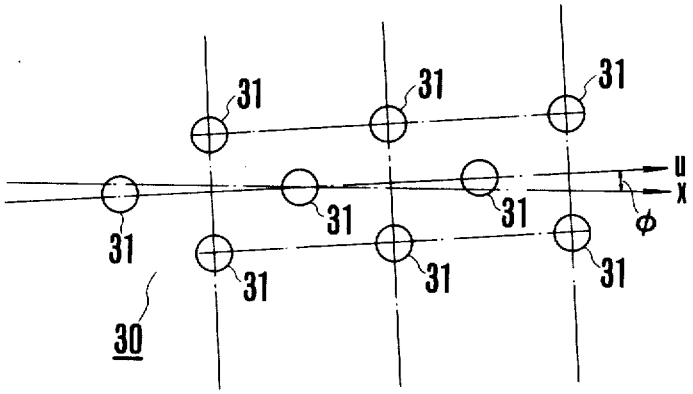
FIG. 3 is a plan view of an essential portion of one example of a shadow mask according to the present invention.

Referring now to FIG. 3, a shadow mask 30 for use in a color picture tube (not shown) which embodies the present invention is constructed by aligning apertures 31 in the direction of B in which electron beams 20*b*, 20*g* and 20*r* on each scanning line are aligned depending on the geometry of the panel at the corner (right-lower corner) of the screen. More particularly, the horizontal (U-direction) arrangement of the apertures 31 is inclined with respect to horizontal axis X of the shadow mask 30 by an electron beam arrangement distortion angle $\phi$ as shown in FIG. 1 where $\phi$ is a variable function of position as given in FIGS. 5 and 6.

Figure 4:
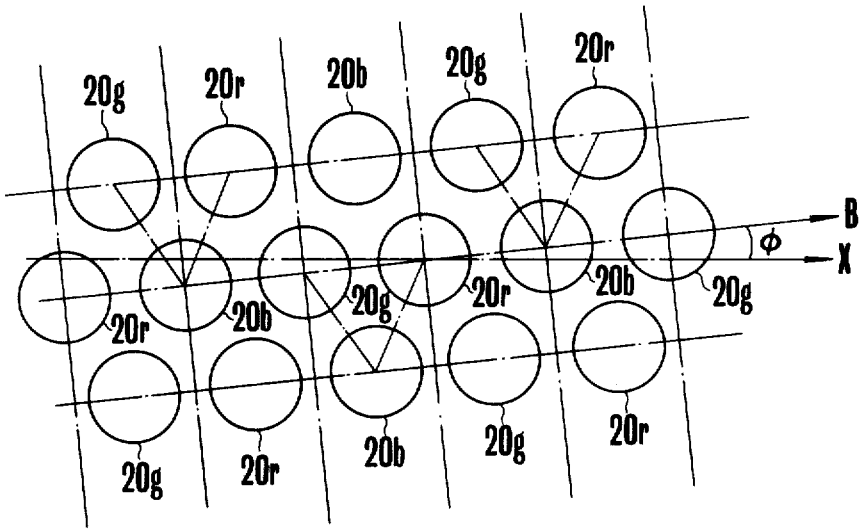
FIG. 4 shows an arrangement of electron beams obtained by using a shadow mask of the present invention.

In this case, the arrangement of electron beams on each scanning line may be made geometrically ideal in respect of the purity properties as shown in FIG. 4 if the arrangement of the apertures of the shadow mask 30 is suitably designed. By using a suitable correction lens such as a continuous correction lens or multi-lens for exposure, the optimum arrangement of trios of phosphor dots may be aligned with the direction B of the electron beam arrangement, thus providing a greater purity tolerance than in the prior art.

Figure 5:
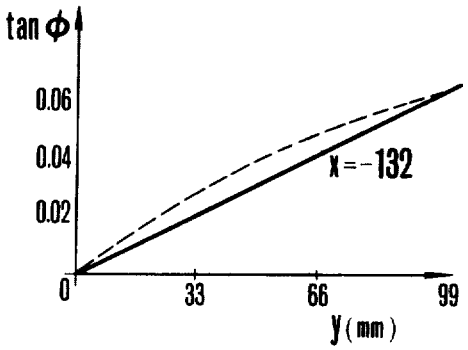
FIG. 5 shows the correlation between the tangent of the inclination relative to the horizontal line formed by the beam trio arrangement and the coordinates x and y when x is fixed.
Figure 6:
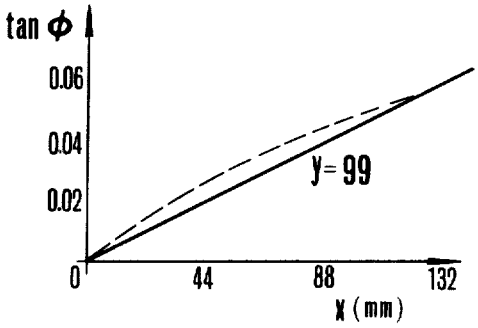
FIG. 6 is a similar graph in which y is fixed.
Figure 7:
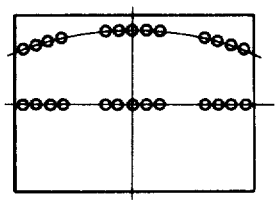
FIG. 7 shows the horizontal arrangement of shadow mask apertures according to the teachings of FIG. 3.

The angle $\phi$ between the horizontal axis x and the beam trio arrangement direction B will be detailed herein. FIG. 5 shows by a broken line the relation between vertical position y of the beam trio arrangement and tan $\phi$ on a vertical line as defined by fixing horizontal position x at x = −132 mm when the origin of Cartesian coordinates coincides with the center of the picture screen. FIG. 6 similarly shows the relation between horizontal position x and tan $\phi$ on a horizontal line of y = 99 mm. The broken line curves in these figures are obtained by plotting values measured in respect of 13 V 90° deflection type tube. The above relations can be approximated by a linear equation, $$\tan\phi = \frac{dy}{dx} = Axy \tag{1}$$

which is illustrated at solid lines in the figure. In this approximation, $$A = -4.6\times 10^{-6}$$

is obtained for the color picture tube of the type mentioned above.

If the arrangement of apertures in the shadow mask is forced to line along the horizontal line by neglecting such a distortion, the tolerance in color purity is drastically reduced, brightness becomes different at the center and the corner of the screen, and the quality of picture is deteriorated, as described above. Accordingly, inclining the horizontal arrangement of apertures 31 by the angle $\phi$ in accordance with the present invention as mentioned above is aligning the horizontal arrangement of the shadow mask apertures with the arrangement of trios of deflected beams which has an inclination relative to the horizontal axis growing toward the corners of the screen. Therefore, coordinates (x, y) of the phosphor dots correspond to those of the shadow mask apertures according to the present invention.

In general, alignment curves may be obtained from differential equation (2), $$\left.\begin{aligned} \tan\phi &= \frac{dy}{dx} = f(x, y) \\ y(x=0) &= \frac{m}{2}Pv \end{aligned}\right\} \tag{2}$$

where m is an integer and Pv represents the vertical pitch between apertures of the shadow mask at (0, 0). But, since errors are negligible even with f (x, y) = Axy as indicated in FIGS. 5 and 6, the approximation pursuant to equation (1) is maintained. Then, by solving equation (2), the aperture arrangement curve expressed by equation (3) is obtained.

$$y = \frac{mPv}{2}\cdot\epsilon^{\frac{1}{2}Ax2}, \tag{3}$$

where $\epsilon$ is the base for natural logarithms.

Accordingly, by determining the horizontal arrangement of apertures of the shadow mask, it is possible to make uniform the interdistance between adjacent electron beams on the fluorescent screen based on beams of electrons which pass through apertures at the shadow mask corners upon deflection of electron beam.

Incidentally, as is clear from equation (3), when the horizontal arrangement of apertures of the shadow mask is aligned with the direction of the beams arranged at the time of beam deflection, y becomes smaller at positions near the horizontal edge than at the center, naturally making the aperture vertical pitch near the edge shorter than at the central portion.

A color picture tube comprising an in-line type three-electron gun structure and a dot type shadow mask (unlike the usual vertical stripe type) can be utilized for character display in a video data terminal unit and the number of scanning lines may be increased as desired in order to improve the resolution. When the number of horizontal scanning lines is increased, the vertical pitch between apertures must be decreased so as to prevent moire pattern arising from interference. When three electron guns are arranged in in-line, freedom to allowance for the vertical pitch variation is large unlike the delta type arrangement; however, there exists such a limitation that the horizontal pitch should be $\sqrt{3}$ times as large as the vertical pitch if regularly circular phosphor dots of R, G, and B are arranged in a regular triangle configuration or with the greatest density to obtain high utilization efficiency of the electron beam.

However, if the horizontal pitch is reduced to agree with the above condition in compliance with the decrease in the vertical pitch, so-called q size or the distance between the shadow mask and the fluorescent screen on the inner surface of the panel and the curvature of the mask should be altered in order to achieve the optimum condition for beam landing. This will require a new die for shaping a curved surface of the shadow mask. Thus, many difficulties are encountered in increasing the number of horizontal scanning lines and reducing the vertical pitch in the aperture arrangement.

Considering the fact that the production of this type of color picture tubes is smaller than that of the color TV picture tubes, it is practical to set the vertical pitch in the aperture arrangement independently of the horizontal pitch so as not to require changes in the horizontal pitch, since the die for the curved mask surface and the correction lens may be used without any modification. The arrangement of the apertures in a shadow mask in this case may be expressed by equation (4);

$$\left.\begin{aligned} x &= \frac{n}{2} P_H \\ y &= \frac{mPv}{2} \epsilon^{\frac{1}{2} A \left(\frac{nPH}{2}\right)2} \end{aligned}\right\} \quad (4)$$

where n is an integer, (m+n) should be an even number and $P_H$ is the horizontal pitch at the center of the shadow mask.

Figure 8:
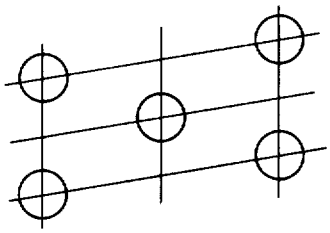
FIG. 8 shows the arrangement of circular apertures at the corner of a shadow mask where vertical pitch is determined independent of the horizontal pitch.
Figure 9:
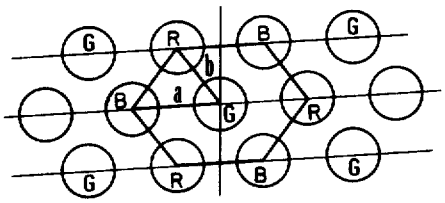
FIG. 9 shows the arrangement of phosphor dots corresponding to the mask shown in FIG. 8.

However, if the arrangement of circular apertures as in the FIG. 3 embodiment is applied to a shadow mask in accordance with equation (4), the apertures are arranged at the corner as shown in FIG. 8 while the arrangement of the phosphor dots corresponding thereto becomes as shown in FIG. 9. Distances a and b in FIG. 9 are different and accordingly, the tolerance for color purity varies in different directions and the high density arrangement of phosphor dots cannot be realized. Therefore, the diameter of an aperture of regular circle has to be designed to meet the shortest distance b. Consequently, the phosphor dot arrangement cannot be of high density, failing to make full use of the purity tolerance.

In another embodiment of the present invention, therefore, for the purpose of improving the beam utilization efficiency by making highly dense the phosphor dot arrangement, the vertical aperture pitch is made independent of the horizontal aperture pitch and in addition thereto, the shape of the aperture is specified. More particularly, the circular aperture is gradually changed into an ellipse aperture as the arrangement of phosphor dots deviates from the desired condition of the closest density. The longer diameter L of the ellipse apertures is aligned with the direction of the beam trio arrangement at the time of beam deflection and the ratio of the shorter diameter S to the longer diameter L is reduced corresponding to the horizontal deviation $X = nP_H$ from the center of the mask as expressed in equation (5).

$$L/S = \epsilon^{\frac{1}{2} A \left(\frac{nPH}{2}\right)2} \quad (5)$$

Figure 10:
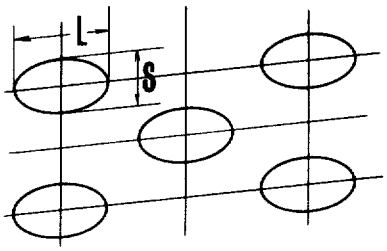
FIG. 10 shows a corner part of a shadow mask of another embodiment according to the present invention.

FIG. 10 shows the arrangement of apertures near the four corners of the shadow mask in accordance with this embodiment.

In general, assuming that peripheral apertures have a diameter ratio as expressed by $\eta(x, y)$ in comparison with the center aperture and that the diameter of the center aperture is D, the function defined by equation (6) is obtained.

$$\sqrt{SL} = \eta(x, y)D \quad (6)$$

Then, by providing an ellipse aperture having the longer diameter L and the shorter diameter S which satisfy equations (4), (5) and (6), it is possible to easily produce a shadow mask having a desired beam transmission distribution and an excellent beam utilization efficiency from an existing die for curved surface of the shadow mask and correction lens.

As described above, this embodiment ensures easy design and production of a shadow mask by using a conventional shadow mask shaper die, the shadow mask of this embodiment being free from moire interference and capable of realizing the desired beam utilization with the closest density when used in a shadow mask type display color picture which is different from the usual color picture tube in the number of horizontal scanning lines. This embodiment further achieves such an effect as to freely control grading all over the screen.

What is claimed is:

1. In a color picture tube comprising a fluorescent screen formed on the inner surface of the panel and consisting of a majority of trios of phosphor dots, a dot type shadow mask having apertures which are arrayed horizontally and vertically and spaced from the fluorescent screen by a predetermined distance, and an in-line type three-electron-gun structure for emitting beams of electrons which pass through said apertures of the shadow mask and impinge upon the fluorescent screen to establish trios of electron beams, the improvement wherein the horizontal arrangement of said apertures is defined by, $$x = \frac{n}{2} P_H$$

$$y = \frac{mPv}{2} \epsilon^{\frac{1}{2} A \left(\frac{nPH}{2}\right)2}$$

where x and y represent coordinates of the apertures of the shadow mask in Cartesian coordinates whose origin coincides with the center of the fluorescent screen, Pv the vertical pitch between apertures of the shadow mask at coordinates (0, 0), $P_H$ the horizontal pitch between apertures at coordinates (0, 0), m and n an integer, (m+n) being an even number, and A a constant, such that the interdistance between adjacent electron beams on the fluorescent screen based on beams of electrons passing through said apertures at the corners of the shadow mask is made substantially equal.

2. Apparatus according to claim 1 wherein said apertures are circular.

3. Apparatus according to claim 1 wherein said apertures are elliptical.

4. A color picture tube as recited in claim 3 wherein the aperture is of ellipse whose longer diameter L and shorter diameter S are defined by:

$$L/S = \epsilon^{\frac{1}{2} A \left(\frac{nPH}{2}\right)2}$$

and wherein said horizontal arrangement is defined by, $$x = \frac{n}{2} P_H$$

$$y = \frac{mPv}{2} \epsilon^{\frac{1}{2} A \left(\frac{nPH}{2}\right)2}$$

where x and y represent coordinates of the apertures of the shadow mask in Cartesian coordinates whose origin coincides with the center of the fluorescent screen, Pv the vertical pitch between apertures of the shadow mask at coordinates (0, 0), $P_H$ the horizontal pitch between apertures at coordinates (0, 0), m and n an integer, (m+n) being an even number, and A a constant.

* * * * *